US011835243B2

(12) United States Patent
Tang et al.

(10) Patent No.: US 11,835,243 B2
(45) Date of Patent: Dec. 5, 2023

(54) AIR CONDITIONER NETWORKING METHOD AND TERMINAL

(71) Applicant: Gree Electric Appliances, Inc. of Zhuhai, Guangdong (CN)

(72) Inventors: Jie Tang, Guangdong (CN); Tieying Ye, Guangdong (CN); Dongfeng Lai, Guangdong (CN); Du Yang, Guangdong (CN); Zhigao Lu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 18/113,698

(22) Filed: Feb. 24, 2023

(65) Prior Publication Data

US 2023/0204247 A1 Jun. 29, 2023

Related U.S. Application Data

(62) Division of application No. 17/047,024, filed as application No. PCT/CN2018/120652 on Dec. 12, 2018, now Pat. No. 11,609,022.

(30) Foreign Application Priority Data

Apr. 13, 2018 (CN) ..... 201810333789.0

(51) Int. Cl.

| | |
|---|---|
| ***F24F 11/89*** | (2018.01) |
| ***F24F 11/32*** | (2018.01) |
| ***F24F 11/58*** | (2018.01) |

(52) U.S. Cl.
CPC ..... *F24F 11/89* (2018.01); *F24F 11/32* (2018.01); *F24F 11/58* (2018.01)

(58) Field of Classification Search
CPC .. F24F 11/89; F24F 11/32; F24F 11/58; F24F 11/54; F24F 11/49; F24F 11/56; F24F 11/00
See application file for complete search history.

(56) References Cited

U.S. PATENT DOCUMENTS

| | | | | |
|---|---|---|---|---|
| 10,120,400 | B2 * | 11/2018 | Matsuno | F24F 11/62 |
| 10,291,425 | B2 | 5/2019 | Amano et al. | |
| 2012/0123561 | A1 | 5/2012 | Park et al. | |
| 2014/0324231 | A1 | 10/2014 | Kawai | |
| 2015/0078391 | A1 * | 3/2015 | Kubo | F24F 11/84 370/400 |

(Continued)

FOREIGN PATENT DOCUMENTS

| | | | |
|---|---|---|---|
| CN | 103615789 | A | 3/2014 |
| CN | 104089370 | A | 10/2014 |

(Continued)

*Primary Examiner* — Nelson J Nieves
*Assistant Examiner* — Matthew John Moscola
(74) *Attorney, Agent, or Firm* — The Webb Law Firm

(57) ABSTRACT

The disclosure provides a networking method and a networking device for an air conditioner, and a terminal, wherein the networking method includes: acquiring indoor unit information of a target air conditioner indoor unit of an air conditioner by a remote controller; matching an air conditioner outdoor unit corresponding to the target air conditioner indoor unit; and establishing a communication connection between the target air conditioner indoor unit and the matching air conditioner outdoor unit.

6 Claims, 4 Drawing Sheets

(56) References Cited

U.S. PATENT DOCUMENTS

2019/0346166 A1 11/2019 Koizumi et al.

FOREIGN PATENT DOCUMENTS

| | | | |
|---|---|---|---|
| CN | 204043128 | U | 12/2014 |
| CN | 104613590 | A | 5/2015 |
| CN | 104748289 | A | 7/2015 |
| CN | 104791940 | A | 7/2015 |
| CN | 105953370 | A | 9/2016 |
| CN | 106322622 | A | 1/2017 |
| CN | 106322662 | A | 1/2017 |
| CN | 107504642 | A | 12/2017 |
| CN | 108662718 | A | 10/2018 |

* cited by examiner

AIR CONDITIONER NETWORKING METHOD AND TERMINAL

CROSS-REFERENCE TO RELATED APPLICATIONS

The present application is a divisional application of U.S. application Ser. No. 17/047,024, filed on Dec. 12, 2018, which is the U.S. National Phase Application under 35 U. S U.S.C. § 371 of International Patent Application No. PCT/CN2018/120652, filed on Dec. 12, 2018, and based on and claims priority to Chinese application for invention No. CN201810333789.0, filed on Apr. 13, 2018, the disclosures of which are hereby incorporated in their entirety.

TECHNICAL FIELD

The present disclosure relates to the field of networking of air conditioners, and in particular to an air conditioner networking method and a terminal.

BACKGROUND

In the related art, the communication between air conditioner outdoor units and air conditioner indoor units is performed by wired connection.

SUMMARY

According to one aspect of the embodiments of the disclosure, there is provided an air conditioner networking method, comprising: acquiring indoor unit information of a target air conditioner indoor unit of the air conditioner by a remote controller; matching an air conditioner outdoor unit corresponding to the target air conditioner indoor unit according to the indoor unit information; and establishing a communication connection between the target air conditioner indoor unit and the matched air conditioner outdoor unit.

According to another aspect of the embodiments of the disclosure, there is also provided an air conditioner networking method, comprising: acquiring outdoor unit information of a target air conditioner outdoor unit of the air conditioner by a remote controller; matching an air conditioner indoor unit corresponding to the target air conditioner outdoor unit according to the outdoor unit information of the target air conditioner outdoor unit; and establishing a communication connection between the target air conditioner outdoor unit and the matched air conditioner indoor unit.

According to another aspect of the embodiments of the disclosure, there is also provided a terminal, comprising: a memory; and a processor coupled to the memory and configured to perform the foregoing air conditioner networking method based on instructions stored in the memory.

According to another aspect of the embodiments of the disclosure, there is also provided a terminal, comprising: a memory; and a processor coupled to the memory and configured to perform the foregoing air conditioner networking method based on instructions stored in the memory.

According to another aspect of the embodiments of the disclosure, there is also provided a non-transitory computer readable storage medium storing computer instructions thereon that are executed by a processor to perform operations of the foregoing air conditioner networking method.

According to another aspect of the embodiments of the disclosure, there is also provided a non-transitory readable storage medium storing computer instructions thereon that are executed by a processor to perform operations of the foregoing air conditioner networking method.

BRIEF DESCRIPTION OF THE DRAWINGS

The accompanying drawings, which are illustrated herein to provide a further understanding of the disclosure, constitute a part of this disclosure. The illustrative embodiments and the description of the disclosure serve to explain the disclosure but do not to limit the disclosure. In the drawings.

DETAILED DESCRIPTION

Figure 1:
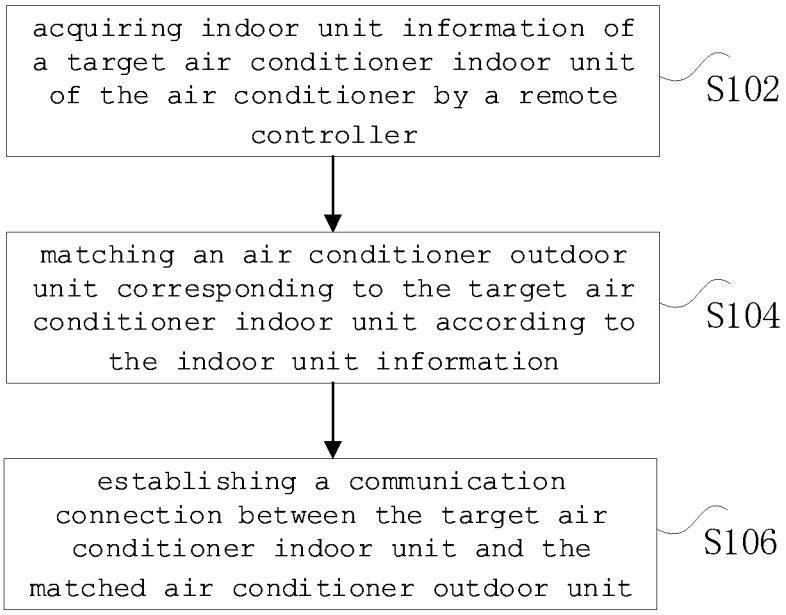
FIG. 1 is a flowchart of an air conditioner networking method according to some embodiments of the disclosure.

In order to enable those skilled in the art to better understand the solutions of the disclosure, the technical solutions in the embodiments of the present disclosure will be clearly and completely described below with reference to the accompanying drawings in the embodiments of the present disclosure. Obviously, the described embodiments are only a part of the embodiments of the present disclosure instead of all of them. All other embodiments that are obtainable to those skilled in the art based on the embodiments of the present disclosure without any creative effort are comprised in the protection scope of the present disclosure.

It should be noted that, the terms "first", "second" and the like in the description and claims and in the drawings of the disclosure are used for distinguishing between similar objects and not necessarily for describing a particular sequential or chronological order. It is to be understood that the data used in this way is interchangeable under appropriate circumstances such that the embodiments of the disclosure described herein are able to be carried out in other sequences than those illustrated or described herein. Moreover, the terms "comprising" and "having" and any variations thereof, are intended to cover a non-exclusive inclusion, such that a process, method, system, product, or apparatus that comprises a series of steps or elements is not necessarily limited to those steps or elements explicitly listed, but comprises other steps or elements not explicitly listed or inherent to such process, method, product, or apparatus.

In the related art, it needs a tight connection between the air conditioner outdoor units and the air conditioner indoor units. When installed in places such as home and office, it is needed to punch holes to damage a wall body, which makes it difficult to install an air conditioner, and is also inconvenient to communicate between the air conditioner outdoor unit and the air conditioner indoor unit.

In view of the above technical problem in the related art that the wired communication mode between the air conditioner outdoor unit and the air conditioner indoor unit results in difficulty in communication, no effective solution has been proposed yet.

The embodiments of the disclosure provide an air conditioner networking method and a terminal, to at least solve the technical problem in the related art that the wired communication mode between the air conditioner outdoor unit and the air conditioner indoor unit results in difficulty in communication.

In the embodiments of the disclosure, the indoor unit information of the target air conditioner indoor unit of the air conditioner is acquired by the remote controller, the air conditioner outdoor unit corresponding to the target air conditioner indoor unit is matched according to the indoor unit information, and then the remote controller is used as an intermediate communication connection equipment to realize the communication connection between the target air conditioner indoor unit and the matched air conditioner outdoor unit. In these embodiments, the remote controller is used as an intermediate equipment of the wireless connection to realize wireless communication between the air conditioner indoor unit and air conditioner outdoor unit. As compared with the wired connection of the air conditioners in the related art, the wireless networking connection is cost saving, convenient in the installation of the air conditioner remote controller, the air conditioner indoor units and the air conditioner outdoor units, and more convenient in communication, and solves the technical problem in the related art that the wired communication mode between the air conditioners results in difficulty in communication.

To facilitate the understanding of the disclosure for the user, the following explanation is made for some of the terms or nouns involved in the embodiments of the disclosure:

Remote controller: the remote controller in the disclosure is used for controlling wireless communication between outdoor units and indoor units of the air conditioner, and it replaces the related wired controller for connecting the outdoor units and indoor units of the air conditioner, to realize wireless communication between the outdoor units and indoor units of the air conditioner.

The following embodiments are able to be applied to various electrical appliances, and specific electrical appliances used in the disclosure are not limited, and comprise but are not limited to: an air conditioner. Some embodiments of the disclosure takes air conditioner as an example, and the air conditioner in the disclosure comprise outdoor units and indoor units which installed in office areas, factory areas, subways and the like, and specific installation positions of the air conditioner are not limited. The embodiments of the disclosure aim to solve the existing problem of inconvenience in networking of air conditioner indoor units and outdoor units in a wired manner, and the outdoor units and the indoor units are matched in a wireless mode by using a remote controller, so as to realize the communication between the air conditioner indoor units and outdoor units. The indoor units and the outdoor units in some embodiments are multiple, and in the networking, it is needed to match each indoor unit with a corresponding outdoor unit, so as to guarantee smoothness of the communication of the air conditioner. The disclosure will be described below with reference to various embodiments.

Embodiment 1

In accordance with some embodiments of the disclosure, there is provided a method embodiment for networking an air conditioner, and it is noted that the steps illustrated in the flowcharts of the figures are able to be executed in a computer system such as a set of computer executable instructions and that, although a logical order is illustrated in the flowcharts, in some cases, the steps illustrated or described are executed in an order different from here.

FIG. 1 is a flowchart of an air conditioner networking method according to some embodiments of the disclosure, and as shown in FIG. 1, the method comprises the following steps:

Step S102: acquiring indoor unit information of a target air conditioner indoor unit of the air conditioner by a remote controller.

Figure 7:
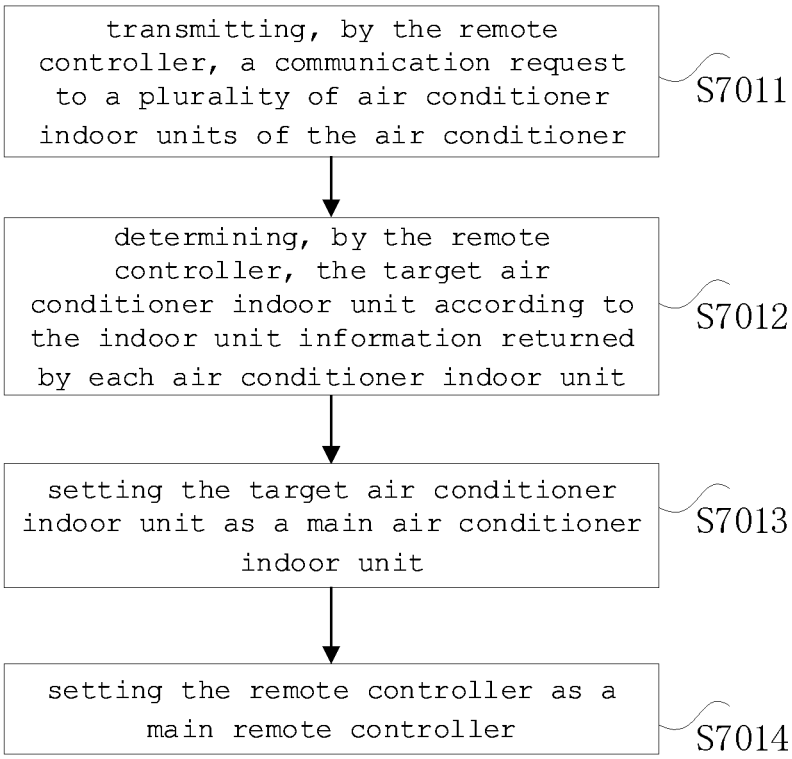
FIG. 7 is a flowchart of the air conditioner networking method according to some other embodiments of the disclosure.

In some embodiments, the remote controller in the disclosure is used as a communication transmission equipment between the air conditioner indoor unit and the air conditioner outdoor unit, and before the wireless communication between the air conditioner indoor unit and the air conditioner outdoor unit is established, an air conditioner indoor unit establishing the communication is determined first. In some embodiments, the wireless communication is established for a plurality of air conditioner indoor units and a plurality of air conditioner outdoor units, each air conditioner indoor unit matched to one air conditioner outdoor unit. FIG. 7 is a flowchart of the air conditioner networking method according to some other embodiments of the disclosure. In some embodiments, before acquiring the indoor unit information of the target air conditioner indoor unit of the air conditioner by the remote controller, the remote controller is also enabled to transmit a communication request to the plurality of air conditioner indoor units of the air conditioner (S7011); and the remote controller determines a target air conditioner indoor unit according to the indoor unit information returned by each air conditioner indoor unit (S7012). That is, in some embodiments, one air conditioner indoor unit is selected from among the plurality of air conditioner indoor units as the air conditioner indoor unit to be communicated (corresponding to the target air conditioner indoor unit described above). Each air conditioner indoor unit is sequentially communication-matched to determine an air conditioner outdoor unit corresponding to each air conditioner indoor unit, thereby establishing a communication connection.

It should be noted that the indoor unit information comprises, but is not limited to: a MAC address of the air conditioner indoor unit, a model of the air conditioner indoor unit, set position information of the air conditioner indoor unit, a communication distance of the air conditioner indoor unit, a type of the air conditioner indoor unit and the like. In some embodiments, the indoor unit information indicates a target air conditioner outdoor unit matched with the target air conditioner indoor unit.

In some embodiments, after the target air conditioner indoor unit is determined, the target air conditioner indoor unit is set as a main air conditioner indoor unit (S7013), and the remote controller is set as a main remote controller (S7014). That is, after the remote controller and the air conditioner indoor unit are matched and the communication between the remote controller and the target air conditioner indoor unit is established, the remote controller and the target air conditioner indoor unit are identified so as to avoid the target air conditioner indoor unit from being repeatedly matched by other remote controllers to cause disordered matching and reduce user experience. In this way, each air conditioner indoor unit is matched to the corresponding remote controller and the corresponding air conditioner outdoor unit.

Step S104: matching the air conditioner outdoor unit corresponding to the target air conditioner indoor unit according to the indoor unit information.

In some embodiments, when matching the air conditioner outdoor unit corresponding to the target air conditioner indoor unit according to the indoor unit information, the air conditioner outdoor unit corresponding to the type of the air conditioner indoor unit is matched, based on at least one of the type of the air conditioner indoor unit or the model of the air conditioner indoor unit.

Step S106: establishing a communication connection between the target air conditioner indoor unit and the matched air conditioner outdoor unit.

By means of the above steps, the communication connection among the air conditioner indoor unit, the air conditioner outdoor unit and the remote controller is realized, so that a synchronous communication among the air conditioner indoor unit, the air conditioner outdoor unit and the remote controller is realized, such that when a state of any one of them is changed, a synchronous request is synchronously sent to the other two, to improve the communication efficiency among the three.

By means of the above steps, the indoor unit information of the target air conditioner indoor unit of the air conditioner is acquired by the remote controller, and the air conditioner outdoor unit corresponding to the target air conditioner indoor unit is matched according to the indoor unit information, and then the remote controller is used as an intermediate communication connection equipment to realize the communication connection between the target air conditioner indoor unit and the matched air conditioner outdoor unit. In these embodiments, the remote controller is used as an intermediate equipment of the wireless connection to realize wireless communication between the air conditioner indoor unit and air conditioner outdoor unit. As compared with the wired connection of the air conditioners in the related art, the wireless networking connection is cost saving, convenient in the installation of the air conditioner remote controller, the air conditioner indoor units and the air conditioner outdoor units, and more convenient in communication, and solves the technical problem in the related art that the wired communication mode between the air conditioners results in difficulty in communication.

Figure 8:
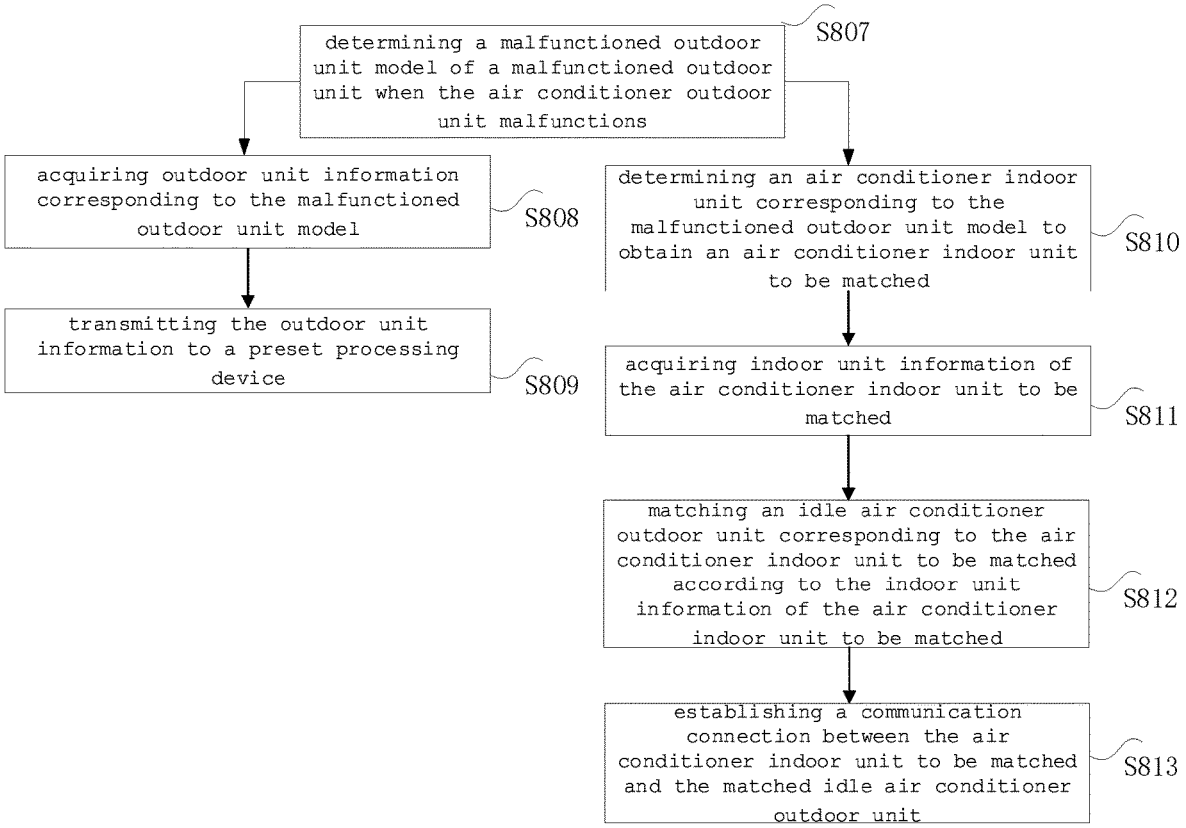
FIG. 8 is a flowchart of the air conditioner networking method according to some other embodiments of the disclosure.

FIG. 8 is a flowchart of the air conditioner networking method according to some other embodiments of the disclosure. In addition, the above embodiments further comprises steps after establishing the communication connection between the target air conditioner indoor unit and the matched air conditioner outdoor unit: determining a malfunctioned outdoor unit model of a malfunctioned outdoor unit when the air conditioner outdoor unit malfunctions (S807); acquiring outdoor unit information corresponding to the malfunctioned outdoor unit model (S808); and transmitting the outdoor unit information to a preset processing device (S809).

That is, after the air conditioner outdoor unit malfunctions, notification information is sent to the preset processing device, so that an operator controlling the preset processing device will know which air conditioner outdoor unit malfunctions in time.

In some other embodiments, the method further comprises steps: after determining the malfunctioned outdoor unit model of the malfunctioned outdoor unit when the air conditioner outdoor unit malfunctions: determining an air conditioner indoor unit corresponding to the malfunctioned outdoor unit model to obtain an air conditioner indoor unit to be matched (S810); acquiring indoor unit information of the air conditioner indoor unit to be matched (S811); matching an idle air conditioner outdoor unit corresponding to the air conditioner indoor unit to be matched according to the indoor unit information of the air conditioner indoor unit to be matched (S812); and establishing a communication connection between the air conditioner indoor unit to be matched and the matched idle air conditioner outdoor unit (S813).

According to the above implementations, when the air conditioner outdoor unit malfunctions, it is able to find another air conditioner outdoor unit to realize the communication connection with the air conditioner indoor unit to be matched, so that the communication between the air conditioner indoor unit and the air conditioner outdoor unit will not be interrupted, and smooth communication is kept.

The embodiments of the disclosure are also adapted to notify the preset processing device that processes air conditioner malfunctions when the air conditioner indoor unit malfunctions, and an idle air conditioner outdoor unit is matched in time to keep the communication connection between the air conditioner indoor unit and the air conditioner outdoor unit.

According to some embodiments of the disclosure, the remote controller and the air conditioner indoor unit are matched on the basis of the wireless communication to obtain the indoor unit information of the air conditioner indoor unit, and an air conditioner outdoor unit of a corresponding type is matched according to the indoor unit information, so as to realize the communication connection among the remote controller, the air conditioner indoor unit and the air conditioner outdoor unit.

Embodiment 2

Figure 2:
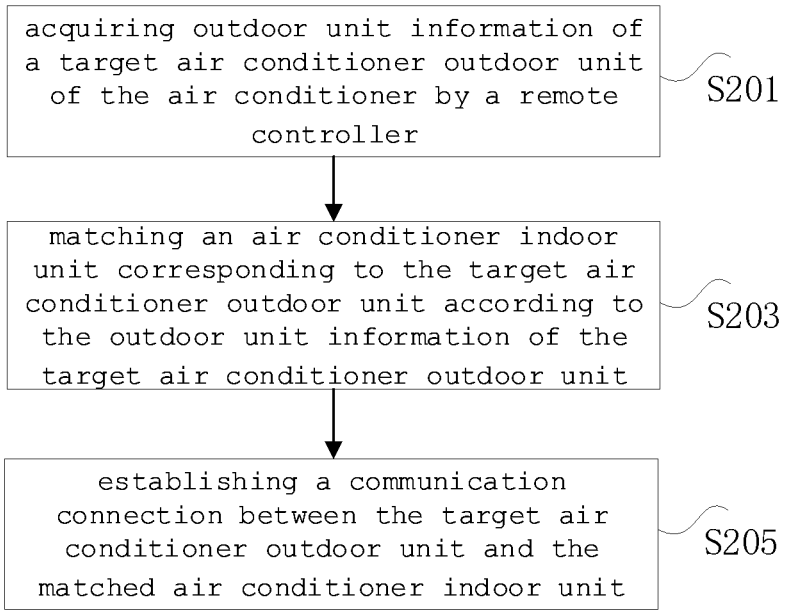
FIG. 2 is a flowchart of another air conditioner networking method according to some embodiments of the disclosure.

FIG. 2 is a flowchart of another air conditioner networking method according to some embodiments of the disclosure, and as shown in FIG. 2, the method comprises:

Step S201: acquiring outdoor unit information of a target air conditioner outdoor unit of the air conditioner by a remote controller.

For instance, the outdoor unit information comprises: a type of the air conditioner outdoor unit, a MAC address of the air conditioner outdoor unit, a serial number of the air conditioner outdoor unit and the like, which indicates how to establish the communication between the air conditioner indoor unit and the air conditioner outdoor unit.

Step S203: matching an air conditioner indoor unit corresponding to the target air conditioner outdoor unit according to the outdoor unit information of the target air conditioner outdoor unit.

Step S205: establishing a communication connection between the target air conditioner outdoor unit and the matched air conditioner indoor unit.

By means of the above steps, a synchronous communication among the target air conditioner outdoor unit, the air conditioner indoor unit and the remote controller is realized, and when any one of them is changed in state, a synchronous request is synchronously sent to the other two, to improve the communication efficiency among the three.

By the above embodiments, the outdoor unit information of the target air conditioner outdoor unit of the air conditioner is acquired by the remote controller, and the air conditioner indoor unit corresponding to the target air conditioner outdoor unit is matched according to the outdoor unit information of the air conditioner outdoor unit, thereby establishing a communication connection between the target air conditioner outdoor unit and the matched air conditioner indoor unit. In these embodiments, the remote controller is utilized for establishing the communication connection between the air conditioner indoor unit and air conditioner outdoor unit. As compared with the wired connection of the air conditioners in the related art, the wireless networking connection is cost saving, convenient in the installation of the air conditioner remote controller, the air conditioner indoor units and the air conditioner outdoor units, and more convenient in communication, and solves the technical problem in the related art that the wired communication mode between the air conditioners results in difficulty in communication.

Figure 9:
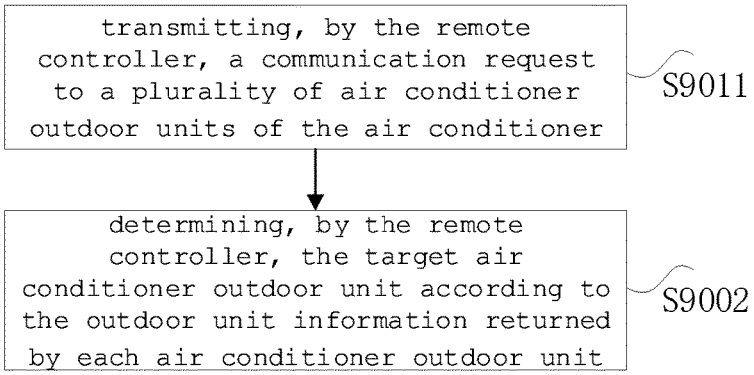
FIG. 9 is a flowchart of the air conditioner networking method according to some other embodiments of the disclosure.

FIG. 9 is a flowchart of the air conditioner networking method according to some other embodiments of the disclosure. In some other embodiments, the method further comprises steps before acquiring the outdoor unit information of the target air conditioner outdoor unit of the air conditioner by the remote controller: transmitting, by a remote controller, a communication request to a plurality of air conditioner outdoor units of the air conditioner (S9001); and determining, by the remote controller, a target air conditioner outdoor unit according to the outdoor unit information returned by each air conditioner outdoor unit (S9002).

In some embodiments, the remote controller is used to realize communication match between the air conditioner outdoor unit and the air conditioner indoor unit, and when matching, the air conditioner is used to realize the synchronous wireless communication between the three.

Embodiment 3

Figure 3:
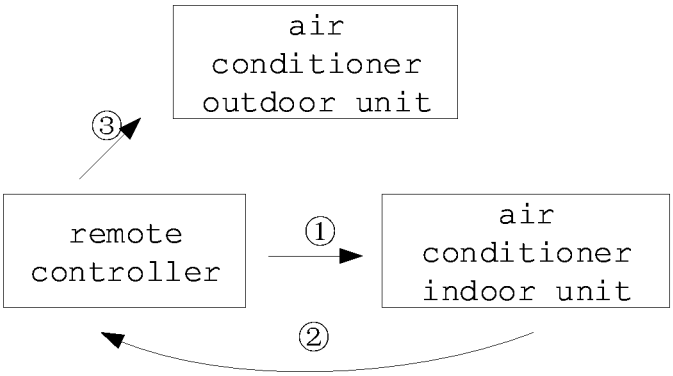
FIG. 3 is a schematic diagram illustrating an air conditioner networking according to some embodiments of the disclosure.

FIG. 3 is a schematic diagram of an air conditioner networking according to some embodiments of the disclosure. As shown in FIG. 3, when the remote controller, the air conditioner indoor unit, and the air conditioner outdoor unit are wirelessly connected, the remote controller sends a matching request to the air conditioner indoor unit (as shown in ① of FIG. 3), and the air conditioner indoor unit performs communication synchronization with the remote controller according to a synchronization request, and returns related indoor unit information to the remote controller (as shown in ② of FIG. 3, the indoor unit information mainly comprises a MAC address), and displays the information on a display screen of the remote controller. A user is able to look for an outdoor unit (as shown in ③ of FIG. 3) matching the indoor unit information according to the indoor unit information received by the remote controller, thereby completing the communication synchronization request among the remote controller, the air conditioner indoor unit, and the air conditioner outdoor unit.

In some embodiments, after the remote controller is successfully paired with the air conditioner indoor unit, the remote controller sets the air conditioner indoor unit successfully paired therewith as a main indoor unit, and automatically sets the remote controller as a main remote controller, to avoid the indoor unit from being repeatedly paired with other remote controllers, thereby causing disordered pairing and reducing user experience.

After the remote controller is successfully matched with the outdoor unit, the remote controller sends a pairing command to the indoor unit, so that the indoor unit and the outdoor unit are also connected in communication, and therefore when one of the remote controller, the indoor unit and the outdoor unit is changed in state, a synchronization request is synchronously sent to the other two, to improve the synchronization efficiency among the three.

In some embodiments, when one outdoor unit in the wireless networking malfunctions, the remote controller reads the malfunctioned outdoor unit through wireless communication and sends it to a remote end through a wireless technology, so that the after-sale technical department will know the information and the position of the malfunctioned outdoor unit at first time. Meanwhile, the remote controller is matched with other idle outdoor units according to the indoor unit information, so that the use of the air conditioner by the user is not delayed while the maintenance personnel maintain the outdoor unit, thus improving the user experience.

In some embodiments, the remote controller in the embodiments of the disclosure is matched ahead of the outdoor unit. The remote controller reads the outdoor unit related information, and displays the outdoor unit information on the display interface, and pair an associated indoor unit according to related outdoor unit information, thereby realizing communication among the remote controller, the indoor unit, and the outdoor unit.

In some embodiments, pairing connection is carried out between the remote controller and the indoor unit on the basis of wireless communication to obtain the indoor unit related information. An outdoor unit of a corresponding type is matched according to the indoor unit related information (MAC address), thereby realizing the communication connection among the remote controller, the air conditioner indoor unit and the air conditioner outdoor unit. As compared with the tradition wired connection, the wireless networking connection is cost saving, and convenient in the installation of the air conditioner indoor units and outdoor units, and the remote controller.

Embodiment 4

Figure 4:
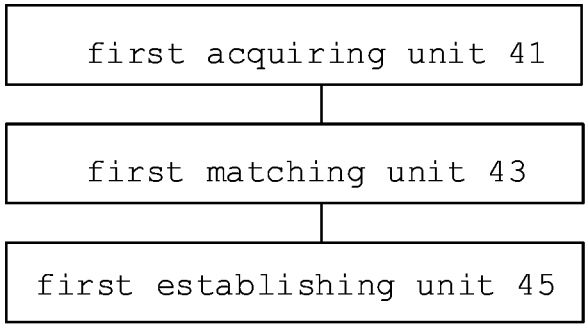
FIG. 4 is a schematic view of an air conditioner networking device according to some embodiments of the disclosure.

FIG. 4 is a schematic diagram of an air conditioner networking device according to some embodiments of the disclosure, and as shown in FIG. 4, the device comprises: a first acquiring unit 41 configured to acquire indoor unit information of a target air conditioner indoor unit of the air conditioner by a remote controller; a first matching unit 43 configured to match an air conditioner outdoor unit corresponding to the target air conditioner indoor unit according to the indoor unit information; and a first establishing unit 45 configured to establish a communication connection between the target air conditioner indoor unit and the matched air conditioner outdoor unit.

With the aid of the above device, the indoor unit information of the target air conditioner indoor unit of the air conditioner is acquired using the first acquiring unit 41 by the remote controller, and the air conditioner outdoor unit corresponding to the target air conditioner indoor unit is matched by the first matching unit 43 according to the indoor unit information, and then the remote controller is used by the first establishing unit 45 as an intermediate communication connection equipment to realize the communication connection between the target air conditioner indoor unit and the matched air conditioner outdoor unit. In these embodiments, the remote controller is used as an intermediate equipment of the wireless connection to realize wireless communication between the air conditioner indoor unit and air conditioner outdoor unit. As compared with the wired connection of the air conditioners in the related art, the wireless networking connection is cost saving, convenient in the installation of the air conditioner remote controller, the air conditioner indoor units and the air conditioner outdoor units, and more convenient in communication, and solves the technical problem in the related art that the wired communication mode between the air conditioners results in difficulty in communication.

In some embodiments, the device further comprises: a first transmitting unit configured to, before acquiring indoor unit information of a target air conditioner indoor unit of the air conditioner by a remote controller, transmit, by the remote controller, a communication request to a plurality of air conditioner indoor units of the air conditioner; and a first determining unit configured to determine, by the remote controller, the target air conditioner indoor unit according to the indoor unit information returned by each air conditioner indoor unit.

In some embodiments, the device further comprises: a first setting unit configured to, after determining the target air conditioner indoor unit, set the target air conditioner indoor unit as a main air conditioner indoor unit; and a second setting unit configured to set the remote controller as a main remote controller.

The device further comprises: a first determining module configured to, after establishing a communication connection between the target air conditioner indoor unit and the matched air conditioner outdoor unit, determine a malfunctioned outdoor unit model of a malfunctioned outdoor unit when the air conditioner outdoor unit malfunctions; a first acquiring module configured to acquire outdoor unit information corresponding to the malfunctioned outdoor unit model; and a transmitting module configured to transmit the outdoor unit information to a preset processing device.

It should be noted that, the device further comprises: a second determining module configured to, after determining a malfunctioned outdoor unit model of a malfunctioned outdoor unit when the air conditioner outdoor unit malfunctions, determine an air conditioner indoor unit corresponding to the malfunctioned outdoor unit model to obtain an air conditioner indoor unit to be matched; a second acquiring module configured to acquire indoor unit information of the air conditioner indoor unit to be matched; a matching module configured to match an idle air conditioner outdoor unit corresponding to the air conditioner indoor unit to be matched according to the indoor unit information of the air conditioner indoor unit to be matched; and an establishing module configured to establish a communication connection between the air conditioner indoor unit to be matched and the matched idle air conditioner outdoor unit.

Figure 5:
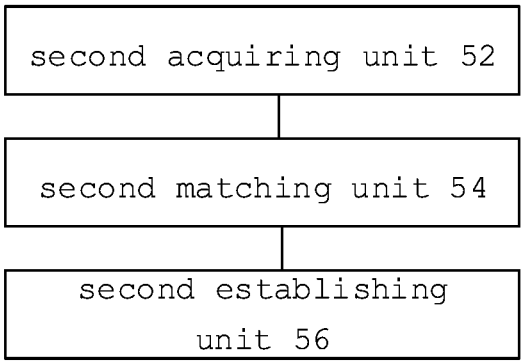
FIG. 5 is a schematic view of another air conditioner networking device according to some embodiments of the disclosure.

FIG. 5 is a schematic diagram of another air conditioner networking device according to some embodiments of the disclosure, and as shown in FIG. 5, the device comprises: a second acquiring unit 52 configured to acquire outdoor unit information of a target air conditioner outdoor unit of the air conditioner by a remote controller; a second matching unit 54 configured to match an air conditioner indoor unit corresponding to the target air conditioner outdoor unit according to the outdoor unit information of the target air conditioner outdoor unit; and a second establishing 56 configured to establish a communication connection between the target air conditioner outdoor unit and the matched air conditioner indoor unit.

With the aid of the above device, the outdoor unit information of the target air conditioner outdoor unit of the air conditioner is acquired using the second acquiring unit 52 by the remote controller, and the air conditioner indoor unit corresponding to the target air conditioner outdoor unit is matched by the second matching unit 54 according to the outdoor unit information of the air conditioner outdoor unit, thereby establishing by the second establishing unit 56 the communication connection between the target air conditioner outdoor unit and the matched air conditioner indoor unit. In these embodiments, the remote controller is used to establish the communication connection between the air conditioner indoor unit and air conditioner outdoor unit. As compared with the wired connection of the air conditioners in the related art, the wireless networking connection is cost saving, convenient in the installation of the air conditioner remote controller, the air conditioner indoor units and the air conditioner outdoor units, and more convenient in communication, and solves the technical problem in the related art that the wired communication mode between the air conditioners results in difficulty in communication.

In some embodiments, the device further comprises: a second transmitting unit configured to, before acquiring outdoor unit information of a target air conditioner outdoor unit of the air conditioner by a remote controller, transmit, by the remote controller, a communication request to a plurality of air conditioner outdoor units of the air conditioner; and a second determining unit configured to determine, by the remote controller, the target air conditioner outdoor unit according to the outdoor unit information returned by each air conditioner outdoor unit.

Embodiment 5

Figure 6:
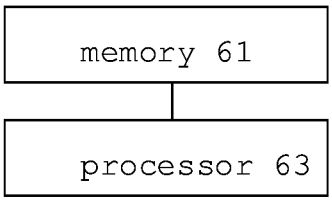
FIG. 6 is a schematic diagram of a terminal according to some embodiments of the disclosure.

FIG. 6 is a schematic diagram of a terminal according to some embodiments of the disclosure, and as shown in FIG. 6, the terminal comprises: a memory 61, a processor 63 coupled to the memory, the memory and the processor communicating over a bus system; the memory configured to store a program, wherein the program, when executed by the processor, controls an equipment where the memory is located to perform any of the air conditioner networking method, the processor configured to run the program, wherein the program, when run, performs any of the air conditioner networking method.

In some embodiments, the processor, when run, performs the following program: acquiring indoor unit information of a target air conditioner indoor unit of the air conditioner by a remote controller; matching an air conditioner outdoor unit corresponding to the target air conditioner indoor unit according to the indoor unit information; and establishing a communication connection between the target air conditioner indoor unit and the matched air conditioner outdoor unit.

In some embodiments, the processor, when run, performs the following program: before acquiring indoor unit information of a target air conditioner indoor unit of the air conditioner by a remote controller, transmitting, by the remote controller, a communication request to a plurality of air conditioner indoor units of the air conditioner; and determining, by the remote controller, the target air conditioner indoor unit according to the indoor unit information returned by each air conditioner indoor unit.

In some embodiments, the processor, when run, performs the following program: after determining the target air conditioner indoor unit, setting the target air conditioner indoor unit as a main air conditioner indoor unit; and setting the remote controller as a main remote controller.

In some embodiments, the processor, when run, performs the following program: after establishing a communication connection between the target air conditioner indoor unit and the matched air conditioner outdoor unit, determining a malfunctioned outdoor unit model of a malfunctioned outdoor unit when the air conditioner outdoor unit malfunctions; acquiring outdoor unit information corresponding to the malfunctioned outdoor unit model; and transmitting the outdoor unit information to a preset processing device.

In some embodiments, the processor, when run, performs the following program: after determining a malfunctioned outdoor unit model of a malfunctioned outdoor unit when the air conditioner outdoor unit malfunctions, determining an air conditioner indoor unit corresponding to the malfunctioned outdoor unit model to obtain an air conditioner indoor unit to be matched; acquiring indoor unit information of the air conditioner indoor unit to be matched; matching an idle air conditioner outdoor unit corresponding to the air conditioner indoor unit to be matched according to the indoor unit information of the air conditioner indoor unit to be matched; and establishing a communication connection between the air conditioner indoor unit to be matched and the matched idle air conditioner outdoor unit.

The above-mentioned serial numbers of the embodiments of the disclosure are merely for description, and do not represent advantages or disadvantages of the embodiments.

In the above embodiments of the disclosure, the description of each embodiment has its own emphasis, and reference is made to a related description of other embodiments for parts that are not described in detail in certain embodiments.

In the several embodiments provided in the present disclosure, it should be understood that the revealed technical content are able to be implemented in other ways. The above-described embodiments of the device are merely illustrative, and for example, the division of the units is a logical division, and in an actual implementation, there is another division, for example, multiple units or components are combined or integrated into another system, or some features are omitted or not executed. In addition, the shown or discussed coupling or direct coupling or communication connection between each other is an indirect coupling or communication connection through some interfaces, units or modules, and is in electrical or other forms.

The units described as separate parts are or aren't be physically separate, and parts displayed as units are or aren't be physical units. That is, they are located in one position or distributed on a plurality of units. In some embodiments, some or all of the units are selected according to actual needs to achieve the purpose of the solution of the embodiments.

In addition, functional units in some embodiments of the present disclosure are integrated into one processing unit, or each unit exist alone physically, or two or more units are integrated into one unit. The integrated units are implemented in the form of hardware, or implemented in the form of a software functional unit.

In some embodiments, the integrated units, if implemented in the form of a software functional unit and sold or used as a separate product, are stored in a computer readable storage medium. Based on such understanding, the technical solutions of the present disclosure in essence, or parts thereof that make a contribution to the related art, or all or part of the technical solutions, are embodied in the form of a software product. The computer software product is stored in a storage medium and comprises several instructions for causing a computer device (for example, a personal computer, a server, or a network device, etc.) to execute all or part of the steps of the method according to the embodiments of the present disclosure. The aforementioned storage medium comprises various media capable of storing program codes such as a U-disk, a Read-Only Memory (ROM), a Random Access Memory (RAM), a removable hard disk, a magnetic disk, or an optical disk.

Only some embodiments of the present disclosure are illustrated above, and it will be appreciated by those skilled in the art that various modifications and adaptations are able to be made without departing from the principles of the present disclosure, and such modifications and adaptations are intended to be within the scope of protection of the present disclosure.

INDUSTRIAL APPLICABILITY

The solutions provided by the embodiments of the present disclosure are able to be used to realize the communication connection between the target air conditioner indoor unit and the matched air conditioner outdoor unit. In the technical solutions provided by the embodiments of the present disclosure, the remote controller is used as an intermediate equipment of the wireless connection to realize wireless communication between the air conditioner indoor unit and air conditioner outdoor unit. The wireless networking connection is cost saving, convenient in the installation of the air conditioner remote controller, the air conditioner indoor units and the air conditioner outdoor units, and is more convenient in communication, and solves the technical problem in the related art that the wired communication mode between the air conditioners results in difficulty in communication.

What is claimed is:

1. An air conditioner networking method, comprising:

acquiring outdoor unit information of a target air conditioner outdoor unit of the air conditioner by a remote controller;

matching an air conditioner indoor unit corresponding to the target air conditioner outdoor unit according to the outdoor unit information of the target air conditioner outdoor unit; and establishing a communication connection between the target air conditioner outdoor unit and the matched air conditioner indoor unit.

2. The air conditioner networking method according to claim 1, further comprising:

transmitting, by the remote controller, a communication request to a plurality of air conditioner outdoor units of the air conditioner; and determining, by the remote controller, the target air conditioner outdoor unit according to the outdoor unit information returned by each air conditioner outdoor unit.

3. A terminal, comprising:

a memory; and a processor coupled to the memory and configured to perform the air conditioner networking method according to claim 1 based on instructions stored in the memory.

4. The terminal according to claim 3, wherein the processor is further configured to perform:

transmitting a communication request to a plurality of air conditioner outdoor units of the air conditioner; and determining the target air conditioner outdoor unit according to the outdoor unit information returned by each air conditioner outdoor unit.

5. A non-transitory readable storage medium storing computer instructions thereon that are executed by a processor to perform operations of the air conditioner networking method according to claim 1.

6. The non-transitory readable storage medium according to claim 5, wherein the operations further comprise:

transmitting, by the remote controller, a communication request to a plurality of air conditioner outdoor units of the air conditioner; and determining, by the remote controller, the target air conditioner outdoor unit according to the outdoor unit information returned by each air conditioner outdoor unit.

* * * * *